US005888110A

United States Patent [19]

Haller et al.

[11] Patent Number: 5,888,110

[45] Date of Patent: Mar. 30, 1999

[54] STEERABLE TOWCRAFT WITH ROOSTERTAIL

[75] Inventors: Clayton Forbes Haller, Pleasant Hill; Charles Prior Hall, Santa Rosa, both of Calif.

[73] Assignee: Stearns Inc., St. Cloud, Minn.

[21] Appl. No.: 916,354

[22] Filed: Aug. 22, 1997

Related U.S. Application Data

[63] Continuation-in-part of Ser. No. 788,321, Jan. 24, 1997, Pat. No. 5,819,680.

[51] Int. Cl.[6] ..... B63B 35/73

[52] U.S. Cl. ..... 441/66; 441/71

[58] Field of Search ..... 441/65, 66, 71, 441/72

[56] References Cited

U.S. PATENT DOCUMENTS

| | | | |
|---|---|---|---|
| 3,020,568 | 2/1962 | Tierney | 441/71 |
| 3,120,011 | 2/1964 | Gunderson | 441/72 |
| 3,255,472 | 6/1966 | Thorne | 441/71 |
| 5,383,804 | 1/1995 | Mitch et al. | 441/66 |

FOREIGN PATENT DOCUMENTS

| | | | |
|---|---|---|---|
| 2250551 | 6/1975 | France | 441/71 |
| 40 07 645 A 1 | 9/1991 | Germany | 114/253 |

*Primary Examiner*—Sherman Basinger
*Attorney, Agent, or Firm*—Flehr Hohbach Test Albritton and Herbert

[57] ABSTRACT

Steerable towcraft having a buoyant body upon which a person can ride, a towline attached to body and adapted for connection to the pulling vessel, a fin on the under side of the body for guiding the body through water, and a steering line connected to the towline at a point spaced from the body. By pulling on the steering line, a person riding on the body can change the angle of the fin relative to the towline, and thereby control the direction in which the towcraft is moving. Water is taken in from beneath the body and sprayed in the form of a roostertail into the air behind the craft as it travels through the water. In some embodiments, a whistle or other noisemaker is actuated by the water forming the roostertail.

20 Claims, 5 Drawing Sheets

STEERABLE TOWCRAFT WITH ROOSTERTAIL

CROSS REFERENCE TO RELATED APPLICATION

This is a continuation-in-part of Ser. No. 08/788,321, filed Jan. 24, 1997 now U.S. Pat. No. 5,819,680.

BACKGROUND OF THE INVENTION

1. Field of Invention

This invention pertains generally to water sports and, more particularly, to watercraft of the type towed behind a boat or other vessel.

2. Related Art

Children and others enjoy being towed behind boats on a variety of buoyant devices such as inner tubes and the like. Such devices are generally attached to the towing vessels by towlines, and there is no way to steer them. They simply go where the boat takes them, and that can become relatively unchallenging and/or uninteresting when the boat is going slowly and in a straight line.

At higher speeds, when the boat makes a turn, centrifugal force can cause the device to swing outside the wake of the boat and to travel substantially farther and faster than the boat itself is travelling. The rider has no control over where or how fast he is going, and in the event of debris or other obstacles in the water, about all the rider can do to protect himself is let go of the line or fall off the device. With a boat travelling at a speed of 25 mph, the tube can travel at speeds as high as 40 to 50 mph, or more, and jumping or falling into the water at those speeds is not something that most people would want to do.

OBJECTS AND SUMMARY OF THE INVENTION

It is in general an object of the invention to provide a new and improved towcraft for riding behind boats and other pulling vessels.

Another object of the invention is to provide a towcraft of the above character which overcomes the limitations and disadvantages of the prior art.

Another object of the invention is to provide a towcraft of the above character which can be steered by a person riding thereon.

These and other objects are achieved in accordance with the invention by providing a steerable towcraft which has a buoyant body upon which a person can ride, a towline attached to body and adapted for connection to the pulling vessel, a fin on the under side of the body for guiding the body through water, and a steering line connected to the towline at a point spaced from the body. By pulling on the steering line, a person riding on the body can change the angle of the fin relative to the towline, and thereby control the direction in which the towcraft is moving. The towcraft also includes means for taking in water from beneath the body and spraying a roostertail of water into the air behind the craft as it travels through the water. In some embodiments, it also includes a whistle or other noisemaker which is actuated by the water forming the roostertail.

DETAILED DESCRIPTION

Figure 1:
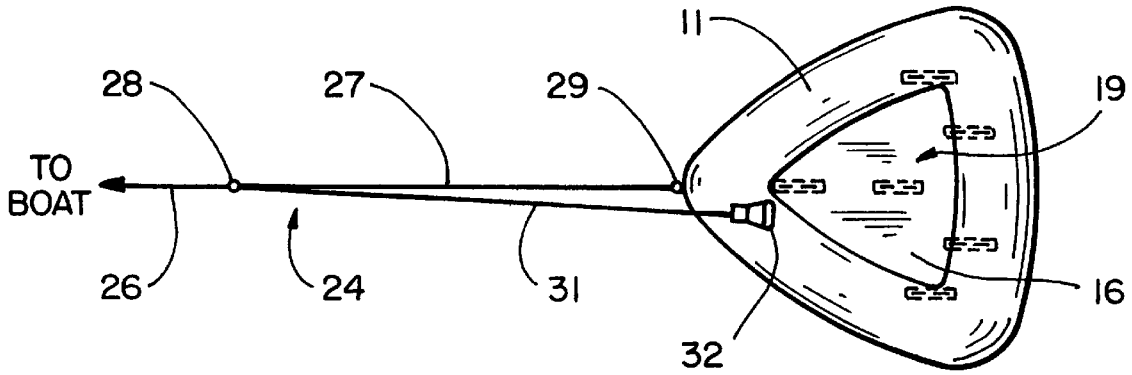
FIG. 1 is a top plan view of one embodiment of a steerable towcraft according to the invention.
Figure 2:
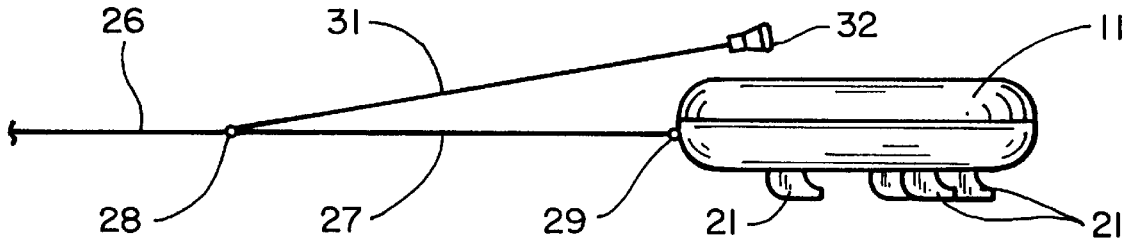
FIG. 2 is a side elevational view of the embodiment of FIG. 1.
Figure 3:
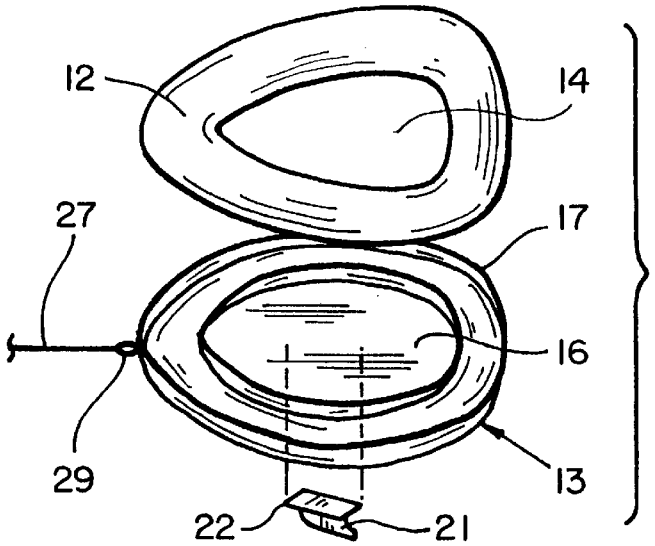
FIG. 3 is a fragmentary exploded view of the embodiment of FIG. 1.

As illustrated in FIGS. 1–3, the towcraft comprises a buoyant body 11 which, in this particular embodiment, consists of a pneumatically inflated tube 12 and a cover or shell 13 which envelopes the tube from below. The tube is fabricated of a material such as vinyl. In plan view, the tube has a generally triangular configuration with rounded corners and a central opening 14. The cover is fabricated of a material such as nylon. It has a bottom wall 16 which extends beneath the tube and a side wall 17 which wraps around the sides and over the top of the tube. The cover is open at the top, and a person riding on the craft sits or kneels in the cavity 19 formed by the opening in the tube and the bottom wall of the cover. The body is assembled by placing the uninflated tube in the cover and inflating it in position.

Fins 21 are provided on the under side of the body for guiding the craft through the water. The number of fins is not critical as long as the fins have sufficient overall area to control the direction of the craft. In the embodiment illustrated, six fins of generally triangular shape are provided. With a tube having an inflated diameter on the order of 12 inches and the body having a length and a width on the order of 4 feet, each of the fins can, for example, have a height on the order of 2½ inches and a length on the order of 6 inches.

The fins are molded of a relatively rigid plastic and have base plates 22 which are affixed to the bottom wall of the cover by suitable means such as sewing. The fins are arranged in a symmetrical pattern, with two of them lying on the longitudinal centerline toward the front of the body and the other four disposed in pairs on opposite sides of the centerline toward the rear of the body.

A towline 24 is attached to the front portion of the body and is adapted for connection to a boat or other pulling vessel (not shown). The towline consists of a long section 26, a short section 27 and a ring 28 between the two sections. The long section is tied or otherwise connected to the boat, and the short section is connected to a ring 29 which is attached to the nylon cover. The longer section can be of any desired length, and the short section typically has a length on the order of 2 to 7 feet.

A steering line 31 is attached to the towline at ring 28. The steering line is somewhat longer than the shorter section of the towline, and has a handle 32 at its free end which can be grasped by a person riding upon the body. With a towline section having a length of 66 inches, for example, the steering line can have a length on the order of 80 inches.

In use, the front section of the towline is tied or otherwise attached to the boat, and the towcraft is pulled through the water by that line. The person riding on the towcraft holds the handle at the free end of the steering line, and pulls on that line when he wants to make a turn. When travelling straight ahead inside the boat's wake, the steering line can be allowed to slacken since the towline is doing the pulling.

When the rider wants to make a turn, he leans and pulls on the steering line in a direction opposite to the way he wants to go. Thus, to move to the right, the rider leans to the left and pulls on the steering line to the left of the towline. To move to the left, he leans to the right and pulls on the steering line to the right of the towing line. Since rings 28, 29 are at relatively fixed points in the towline when that line is taut, pulling on the steering line obliquely of the towline causes the body to pivot about ring 29. As the body turns, fins 21 also turn, and the craft moves in the direction in which the body is headed.

Figure 4A:
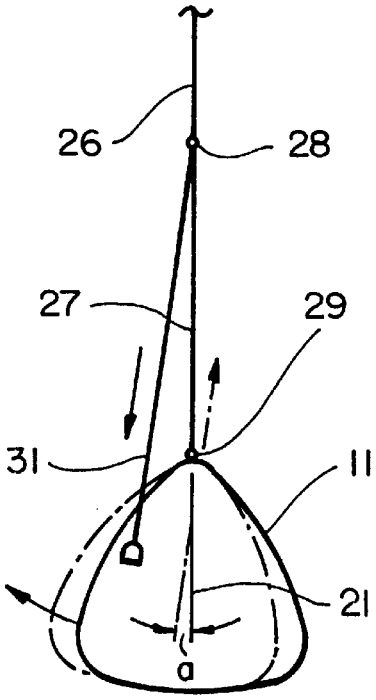
FIGS. 4*a* and 4*b* are diagrammatic views illustrating operation of the embodiment of FIG. 1.
Figure 4B:
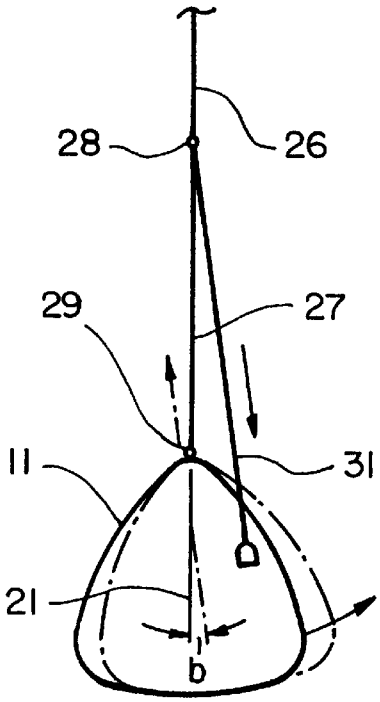

As illustrated in FIG. 4*a*, pulling the steering line to the left causes the rear of towcraft body to swing to the left, changing the orientation of the fins by an angle a and causing the craft to travel to the right. As illustrated in FIG. 4*b*, pulling to the right causes the rear of the craft to swing to the right, changing the orientation of the fins by an angle b and causing the craft to travel to the left.

The angle at which the craft turns is dependent upon the angle of the pull as well as the distance between the front of the craft and the point at which the steering line is connected to the towline, i.e. the distance between rings 28 and 29. As noted above, that distance is generally on the order of 2 to 10 feet, with about 5 providing particularly good steering with a craft of the type and dimensions described above.

Figure 5:
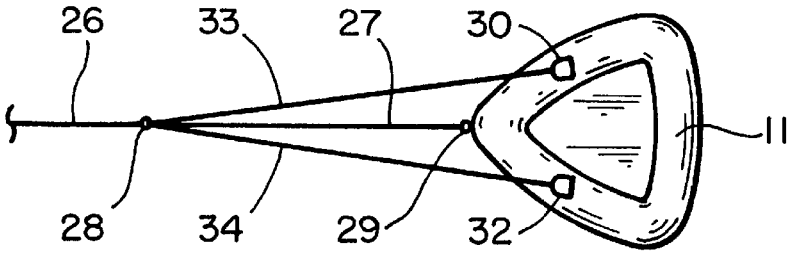
FIGS. 5 and 6 are top plan views of other embodiments of a steerable towcraft according to the invention.

In the embodiment of FIG. 5, a separate steering line 33, 34 is provided for each hand. The front portions of these lines are tied or otherwise affixed to ring 28, and handles 36, 37 are attached to the free ends of the lines. Operation and use of this embodiment is similar to that described above, the only difference being that the rider holds one handle in each hand and pulls upon the line opposite the direction he wants to go. Thus, to travel to the right, he pulls on the line in his left hand, and to travel to the left, he pulls on the line in his right hand.

Figure 6:
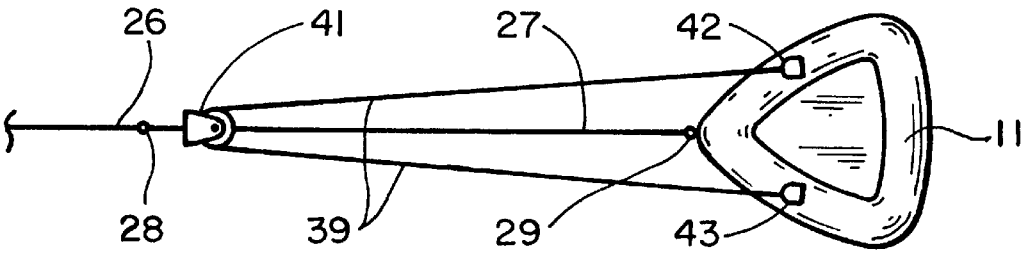

FIG. 6 illustrates an embodiment similar to that of FIG. 5 except the steering line 39 is trained about a pulley 41 attached to ring 28, rather than being affixed directly to the ring. Handles 42, 43 are attached to the two ends of the steering line, and the direction of travel is determined by the net pull exerted on the two ends of the line. Having the line trained about the pulley also gives the rider some additional freedom of positioning and movement since the relative lengths of line in each hand will adjust to accommodate the rider without affecting the steering of the craft.

Figure 7:
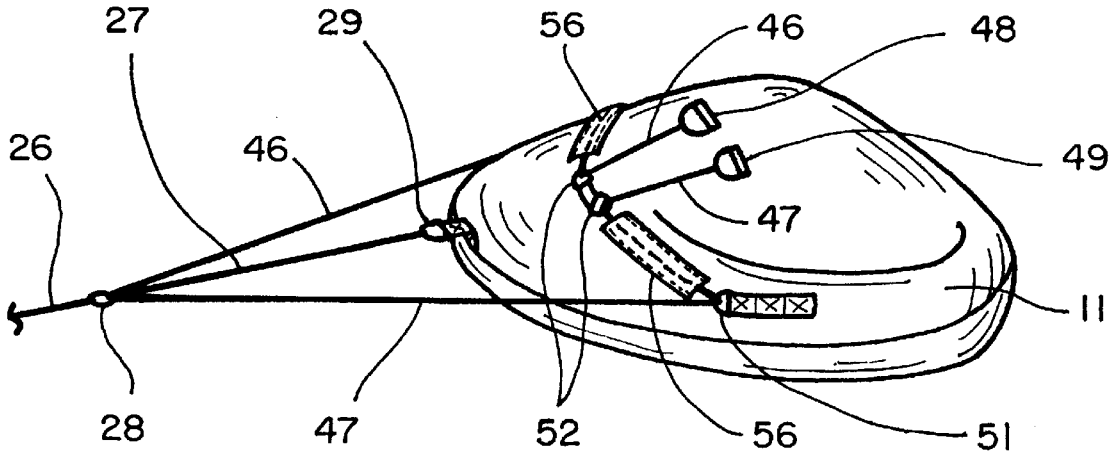
FIGS. 7 and 8 are isometric views of additional embodiments of a steerable towcraft according to the invention.

In the embodiment of FIG. 7, a pair of steering lines 46, 47 with handles 48, 49 are trained about guides 51 which are affixed to the body on opposite sides of the craft. These lines are also trained about a second set of guides 52 which are attached to the body in a more central position. In the embodiment illustrated, the guides consist of D-rings affixed to straps which are sewn to the cover of the body. However, pulleys or other suitable types of guides can be employed, if desired. The portions of the lines between the guides are covered by patches 56 which are sewn to the cover along two opposing edges of the patches to protect the rider from contact with the moving lines.

Operation and use of this embodiment is similar to that of FIG. 5 in that the rider simply pulls on the line on the side opposite the direction he wants to travel, e.g. pulls left to go right. In this embodiment, however, the points at which the pull is applied to the body are fixed by the location of guides 51.

Figure 8:
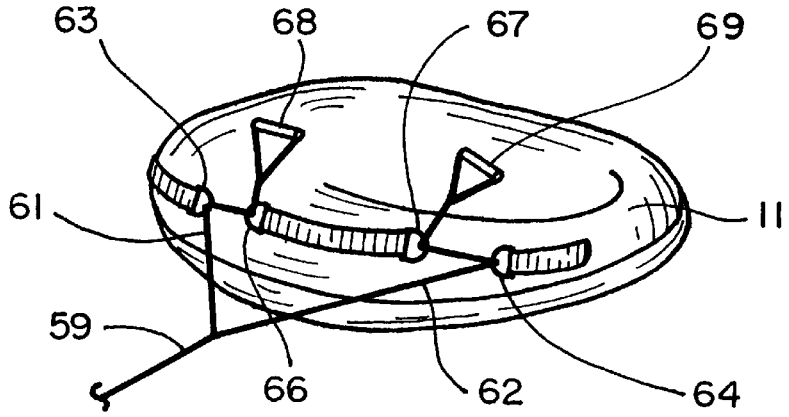

In the embodiment of FIG. 8, a single line 59 is utilized both for towing and for steering. The front portion of this line is attached to the boat, and the rear portion is split into two sections 61, 62 which are trained about guides 63–67. Handles 68, 69 are attached to the free ends of the lines. Guides 63, 64 are affixed to the sides of the body toward the front of the craft, and guides 66, 67 are located closer to the centerline of the craft. The guides are illustrated as being D-rings, but other suitable types of guides, including pulleys, can be employed, if desired.

In operation, the portion of line 59 between the boat and guides 63, 64 serves as the tow line, with the rider holding onto the two handles rather than having the line affixed to the body of the towcraft. To steer, the rider pulls harder on one handle than the other. When he does this, the body of the craft pivots about the guide 63, 64 on the opposite side of the body, and the rear of the craft rotates forward on the side where the greater pull is exerted. As in the other embodiments, the rotation of the body changes the orientation of the fins and causes the craft to move in a direction opposite the side on which the pull is exerted.

Figure 9:
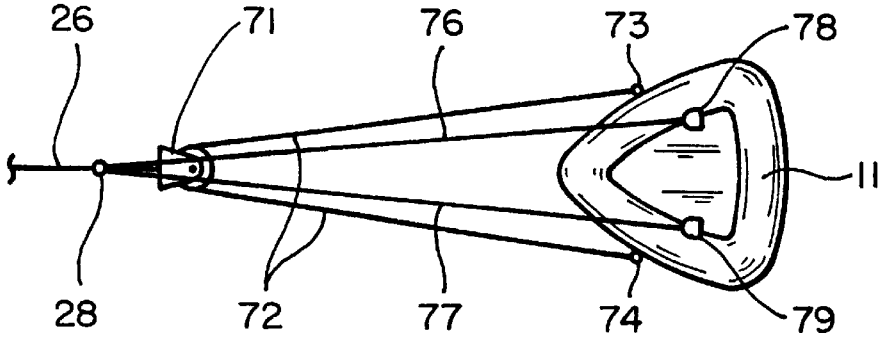
FIG. 9 is a top plan view of another embodiment of a steerable towcraft according to the invention.

In the embodiment of FIG. 9, the towline includes a pulley 71 which is attached to ring 28, and a line 72 which is trained about the pulley and attached to rings 73, 74 on opposite sides of the body. Steering lines 76, 77 are affixed to ring 28, with handles 78, 79 at the ends of the steering lines.

Operation and use of the embodiment of FIG. 9 is similar to that of FIG. 1. However, with line 72 being free to travel about pulley 71, it may be possible to turn the craft at greater angles and to travel farther outside the wake than in the embodiments where the rear section of the towline is affixed to the ring.

Figure 10:
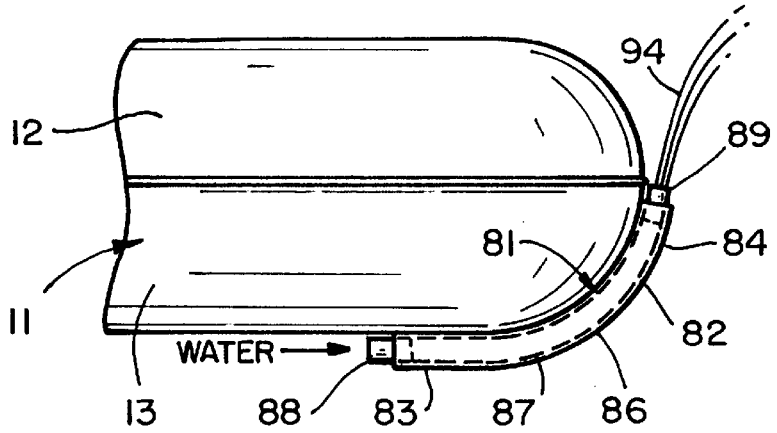
FIG. 10 is a fragmentary side elevational view of another embodiment of a towcraft incorporating the invention.
Figure 11:
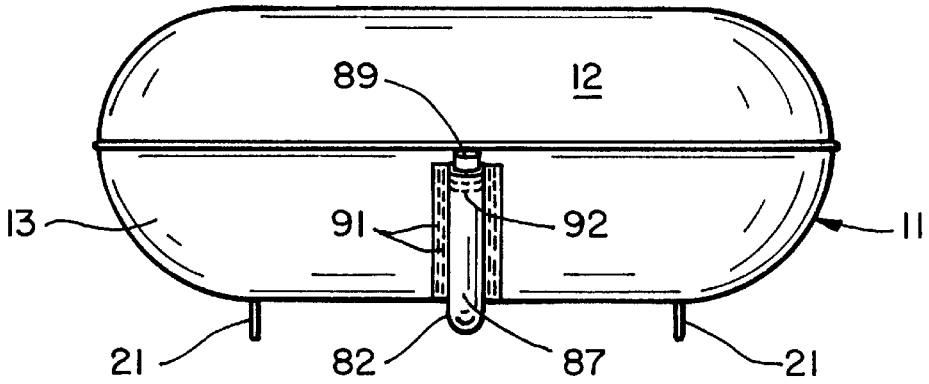
FIG. 11 is a rear elevational view of the embodiment of FIG. 10.

FIG. 10 illustrates an embodiment which includes means for spraying a roostertail of water into the air behind the craft as it travels through the water. As in the previous embodiments, the craft has a buoyant body 11 consisting of a pneumatically inflatable tube 12 with a nylon cover or shell 13. The means for producing the roostertail comprises a tube 81 mounted in a pocket 82 toward the rear of the craft. The tube has a horizontally extending inlet end portion 83 positioned beneath the body and a vertically extending outlet end portion 84 positioned to the rear of the body, with a 90° curve 86 between the two end portions. The opening at the inlet end faces in a forward direction (i.e., the direction in which the craft travels), and is positioned approximately below the front edge of inflatable tube 12 at the rear of the craft. The outlet end is positioned above the centerline of the body so that it will be above the surface of the water when the craft is floating.

In the embodiment illustrated, the tube consists of a length of flexible plastic tubing 87 with nipples 88, 89 in the end portions thereof. The flexible tubing should be soft enough to bend around the lower portion of body 11 but stiff enough not to collapse when the craft is moving through the water. The nipples prevent the end portions of the flexible tubing from collapsing when the water presses against them. In one presently preferred embodiment, the flexible tubing is a clear polyvinyl chloride (PVC) tubing, and the nipples are short lengths of rigid PVC tubing. In a typical embodiment, the flexible tubing has a length of 15 inches and a diameter of one inch, and the two nipples have lengths of one inch and 1½ inches, respectively. Each of the nipples extends one-half inch into the flexible tubing and is cemented in place, with nipple 88 projecting one-half inch beyond the inlet end of the tubing and nipple 89 projecting one inch beyond the outlet end.

If desired, a preformed section of rigid tubing can be utilized instead of the flexible tubing, in which case the nipples at the ends of the tubing are not necessary. However, the flexible tubing is the preferred material since there is less chance of injury in the event that it should strike someone.

Pocket 82 can be fabricated of the same material as cover 13, and is attached to the cover by a double row of stitching 91 along the lateral margins of the pocket. The ends of the pocket are open, and the end portions of the tube extend through them. The pocket made to fit tightly about tubing 87 so that the tubing is held firmly in place, and the upper end portion of the pocket is made narrower than the rest by an additional course of stitching 92 beside the others. That portion is wide enough to receive nipple 89, but not tubing 87, so that the tube cannot be pushed out of the pocket by the water.

The tube is inserted into the pocket from the inlet end of the pocket, and because the fit is snug, insertion may be difficult. If desired, a silicone spray or other suitable lubricant can be employed to make the insertion easier.

Operation and use of this embodiment is similar to that of the others, and the craft can be connected to a pulling vessel and steered in any of the ways discussed above in connection with the other embodiments. As the craft moves through the water, water enters the inlet end of jet tube 81 and is driven through the tube and out the outlet end by the pressure created as the tube moves through the water. The water discharged from the outlet in the form of a roostertail 94 which typically is shot about 10 feet up into the air behind the craft at normal rates of travel.

Figure 12:
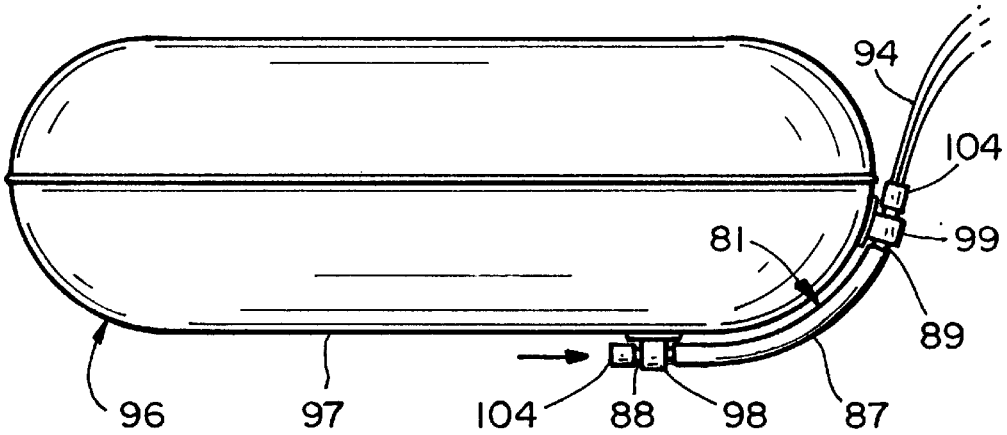
FIG. 12 is a side elevational view of another embodiment of a towcraft incorporating the invention.
Figure 13:
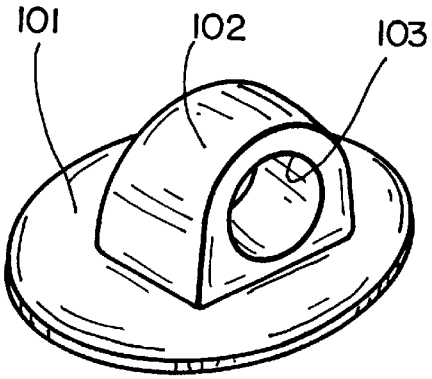
FIG. 13 is an isometric view of a grommet employed in the embodiment of FIG. 12.
Figure 16:
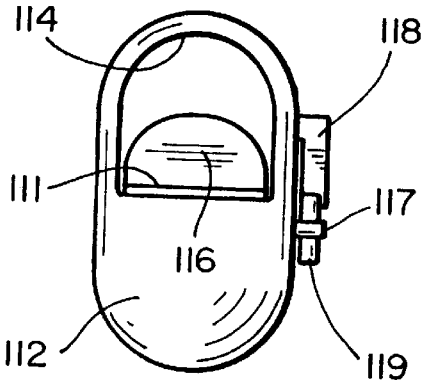
FIG. 16 is a rear elevational view of the embodiment of FIG. 15.

In the embodiment of FIG. 12, the body of the towcraft consists of a pneumatically inflatable tube 96 which is similar to tube 11 with a bottom wall or floor 97 extending across the opening on the lower side of the tube. There is no cover or shell in this embodiment, and the tube and the floor are fabricated of a material such as vinyl or a reinforced vinyl which can be heat sealed or welded together. Tube 96 is connected to a towing vessel and steered in the same manner as the other embodiments.

In this embodiment, jet tube 81 is mounted in a pair of grommets 98, 99 which are affixed to the under and rear sides of inflatable tube 96. Each of the grommets has a generally circular base 101 which is welded or otherwise affixed to the inflatable tube, and an eyelet 102 with an opening 103 through which one of the nipples 88, 89 extends. The diameter of the openings is less than that of tubing 87, and short lengths 104 of the flexible tubing are mounted on the nipples between the grommets and the outer ends of the nipples to keep the tube in place between the grommets. The short lengths of tubing thus serve as retaining rings, and are cemented to the nipples to keep them in place.

As in the embodiment of FIG. 10, the inlet end portion of jet tube 81 extends in a horizontal direction, with the inlet opening facing toward the front of the craft. The outlet end portion of the jet tube extends in a vertical direction on the rear side of the inflatable tube, with nipple 89 extending above the centerline of the tube and out of the water.

Operation and use of this embodiment is similar to that of the embodiment of FIG. 10. As the craft travels through the water, water enters the inlet end of the jet tube, passes through the tube, and is discharged from the outlet end in the form of a roostertail 94 which sprays into the air behind the craft.

Figure 14:
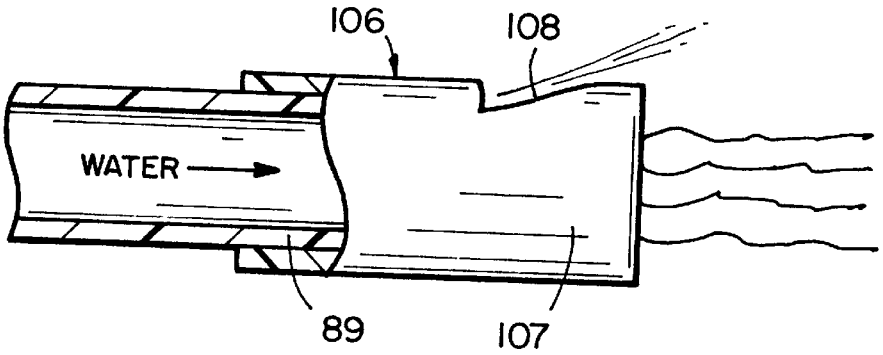
FIGS. 14 and 15 are side elevational views, partly broken away, of two embodiments of noise making attachments for use with the embodiments of FIGS. 10–13.

FIG. 14 illustrates a whistle 106 which can be attached to the outer end of nipple 89 at the discharge end of jet tube 81 in the embodiments of FIGS. 10–13. The whistle includes a generally cylindrical body 107 in which the end portion of the nipple is received with a friction fit. An aperture 108 is formed in the side wall of the cylindrical body, and some of the water passing through the jet tube is diverted through the aperture to produce a whistling sound. The whistle is thus removably attached to the jet tube, and can be installed and removed as desired.

Figure 15:
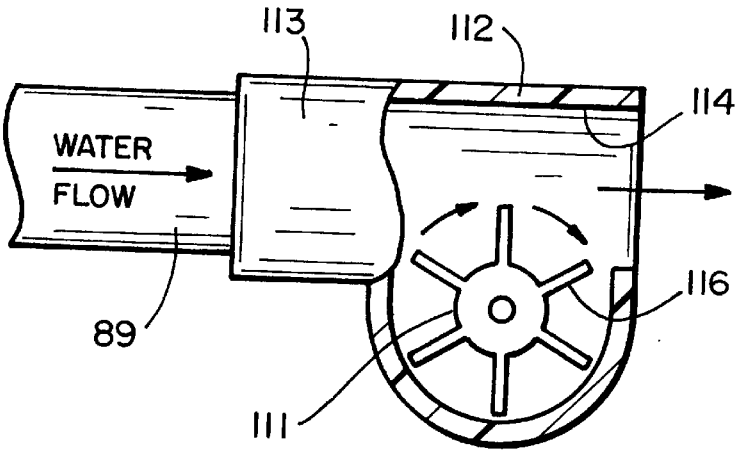

FIG. 15 illustrates another noise maker which can be attached to the discharge end of jet tube 81 to produce an audible sound. This noise maker includes a paddlewheel 111 which is rotatably mounted in a housing 112 that is mounted on nipple 89. The housing has a cylindrical mounting flange 113 which fits over the nipple, with frictional engagement holding the housing on the nipple. An outlet opening 114 is aligned axially with the mounting flange, and the paddlewheel rotates about an axis perpendicular to the axis of the flange, with water flowing through the housing impinging upon the blades 116 on one side of the wheel.

A star wheel 117 affixed to the shaft of the paddlewheel outside the housing engages a flexible reed 118 to produce a clicking sound as the wheel rotates. The upper end of the reed is affixed to the housing, and the lower end extends between the teeth or cogs 119 of the star wheel. The reed is fabricated of a relatively rigid plastic material such as PVC, and can be molded integrally with the housing.

The noise maker can be attached to or removed from the jet tube as desired. When it is attached, water impinging upon blades 116 causes the paddlewheel and the star wheel to rotate. As the star wheel turns, its teeth engage the reed, producing a clicking sound.

The invention has a number of important features and advantages. It permits a person or persons riding on a craft towed by a boat to have complete control over where the craft is going. The rider can simply follow the boat if he wants, he can cut back and forth either inside or outside the wake, and he can steer around debris or other obstacles in the water. Also, if the rider wants to rest, he can simply relax the pull on the steering line(s) and let the craft follow behind the boat. The roostertail serves both an aesthetic function and a safety function in that it draws attention to the craft and reduces the chances that another vessel will run into it. The noisemakers likewise draw attention to the craft as well as being fun for children and other persons riding on it.

It is apparent from the foregoing that a new and improved steerable towcraft has been provided. While only certain presently preferred embodiments have been described in detail, as will be apparent to those familiar with the art, certain changes and modifications can be made without departing from the scope of the invention as defined by the following claims.

We claim:

1. In a recreational towcraft adapted to be pulled through water behind a boat or other towing vessel: a buoyant body upon which a person can ride, means for connecting the body to a towing vessel for travel in a forward direction behind the vessel, means mounted on the body having a water inlet facing in the forward direction and a water outlet facing in an upward direction for taking in water and spraying a roostertail of water into the air as the craft travels through the water, and means including a whistle attached to the water outlet for producing an audible sound.

2. The towcraft of claim 1 wherein the means for connecting the body to a towing vessel comprises a towline and a steering line connected to the towline at a point spaced from the body such that a pull on the steering line at an angle to the towline by a person riding on the body causes the body to turn relative to the towline, thereby changing the direction in which the craft travels through the water.

3. In a towcraft adapted to be pulled through water behind a boat or other towing vessel: a buoyant body upon which a person can ride, means for connecting the body to a towing vessel for travel in a forward direction behind the vessel, and a jet tube having an inlet end positioned beneath the body and an outlet end positioned rearwardly of the body for taking in water from beneath the body and spraying water into the air to the rear of the body as the craft travels through the water, the jet tube comprising a length of flexible tubing having short lengths of rigid tubing inserted in the end portions thereof.

4. The towcraft of claim 3 wherein the means for connecting the body to a towing vessel comprises a towline and a steering line connected to the towline at a point spaced from the body such that a pull on the steering line at an angle to the towline by a person riding on the body causes the body to turn relative to the towline, thereby changing the direction in which the craft travels through the water.

5. The towcraft of claim 3 wherein the inlet end of the jet tube extends in a generally horizontal direction, and the outlet end extends in a generally vertical direction.

6. The towcraft of claim 3 wherein the inlet end of the jet tube includes an opening which faces in the forward direction.

7. In a towcraft adapted to be pulled through water behind a boat or other towing vessel: a pneumatically inflatable tube having a central opening, a flexible shell extending beneath the opening and around the side of the tube to form a cavity in which a person can ride, a pocket on the shell having open ends beneath the tube and on one side of the tube, a length of flexible tubing disposed in the pocket with end portions of the tubing projecting from the open ends of the pocket for taking in water from beneath the tube and spraying a roostertail of water into the air as the craft is pulled through the water, and rigid nipples inserted in the end portions of the flexible tubing.

8. The towcraft of claim 7 including a towline for connecting the tube to a towing vessel, and a steering line connected to the towline at a point spaced from the tube such that a pull on the steering line at an angle to the towline by a person riding on the tube causes the tube to turn relative to the towline, thereby changing the direction in which the craft travels through the water.

9. The towcraft of claim 8 wherein the pocket is stitched to the cover.

10. The towcraft of claim 8 wherein the pocket narrows toward the side of the tube to retain the tubing in position against forces exerted by the water.

11. In a towcraft adapted to be pulled through water behind a boat or other towing vessel: a pneumatically inflatable tube having a front side, a rear side and an opening in which a person can ride, means for connecting the tube to a towing vessel for travel through water with the front side of the tube facing in a forward direction, a pair of grommets affixed toward the rear of the tube with one of the grommets being positioned on the under side of the tube and the other being positioned on the rear side, and a length of flexible tubing extending between the grommets for taking in water from beneath the tube and spraying a roostertail of water into the air to the rear of the tube as the tube travels through the water.

12. The towcraft of claim 11 wherein the means for connecting the tube to a towing vessel comprises a towline and a steering line connected to the towline at a point spaced from the tube such that a pull on the steering line at an angle to the towline by a person riding on the tube causes the tube to turn relative to the towline, thereby changing the direction in which the tube travels through the water.

13. The towcraft of claim 11 including short lengths of rigid tubing which are inserted in the end portions of the flexible tubing and extend through openings in the grommets.

14. The towcraft of claim 13 further including rings of greater diameter than the openings in the grommets mounted on the rigid tubing between the grommets and the ends of the rigid tubing to retain the tubing in the grommets.

15. In a recreational towcraft adapted to be pulled through water behind a boat or other towing vessel: a buoyant body upon which a person can ride, means for connecting the body to a towing vessel for travel in a forward direction behind the vessel, means mounted on the body having a water inlet facing in the forward direction and a water outlet facing in an upward direction for taking in water and spraying a roostertail of water into the air as the craft travels through the water, and means including a paddle wheel attached to the water outlet for producing an audible sound.

16. The towcraft of claim 15 wherein the means for connecting the body to a towing vessel comprises a towline and a steering line connected to the towline at a point spaced from the body such that a pull on the steering line at an angle to the towline by a person riding on the body causes the body to turn relative to the towline, thereby changing the direction in which the craft travels through the water.

17. In a towcraft adapted to be pulled through water behind a boat or other towing vessel: a buoyant body comprising a pneumatically inflated tube and a flexible cover which envelopes the tube and has a pocket with open ends positioned beneath the body and on a rear side of the body, means for connecting the body to a towing vessel for travel in a forward direction behind the vessel, and a jet tube mounted in the pocket with end portions of the jet tube extending through the open ends of the pocket for taking in water from beneath the body and spraying water into the air to the rear of the body as the craft travels through the water.

18. The towcraft of claim 12 wherein the means for connecting the body to a towing vessel comprises a towline and a steering line connected to the towline at a point spaced from the body such that a pull on the steering line at an angle to the towline by a person riding on the body causes the body to turn relative to the towline, thereby changing the direction in which the craft travels through the water.

19. In a towcraft adapted to be pulled through water behind a boat or other towing vessel: a buoyant body upon which a person can ride, means for connecting the body to a towing vessel for travel in a forward direction behind the vessel, a pair of grommets attached beneath the body and to the rear of the body, and a jet tube mounted in the grommets and having an inlet end positioned beneath the body and an outlet end positioned rearwardly of the body for taking in water from beneath the body and spraying water into the air to the rear of the body as the craft travels through the water.

20. The towcraft of claim 19 wherein the means for connecting the body to a towing vessel comprises a towline and a steering line connected to the towline at a point spaced from the body such that a pull on the steering line at an angle to the towline by a person riding on the body causes the body to turn relative to the towline, thereby changing the direction in which the craft travels through the water.

* * * * *